US009272482B2

(12) United States Patent
Sunoo et al.

(10) Patent No.: US 9,272,482 B2
(45) Date of Patent: Mar. 1, 2016

(54) PETAL SHAPED GREETING CARD AND METHOD

(71) Applicants: Florence Sunoo, Los Angeles, CA (US); Vincent Marshel, Los Angeles, CA (US)

(72) Inventors: Florence Sunoo, Los Angeles, CA (US); Vincent Marshel, Los Angeles, CA (US)

( * ) Notice: Subject to any disclaimer, the term of this patent is extended or adjusted under 35 U.S.C. 154(b) by 64 days.

(21) Appl. No.: 13/685,962

(22) Filed: Nov. 27, 2012

(65) Prior Publication Data

US 2014/0144053 A1 May 29, 2014

(51) Int. Cl.

*G09F 1/04* (2006.01)
*B31D 1/00* (2006.01)
*B42D 15/04* (2006.01)

(52) U.S. Cl.

CPC ..... *B31D 1/0075* (2013.01); *B42D 15/04* (2013.01); *B42D 15/042* (2013.01); *G09F 1/04* (2013.01)

(58) Field of Classification Search

CPC ..... G09F 1/04
USPC ..... 40/124.08, 124.09, 124.19, 124.191, 40/602; 446/217, 218, 219, 236, 148, 488, 446/147; 493/393
See application file for complete search history.

(56) References Cited

U.S. PATENT DOCUMENTS

| | | | | | |
|---|---|---|---|---|---|
| 727,723 | A * | 5/1903 | Webb | B65D 5/0254 229/109 |
| 1,549,110 | A * | 8/1925 | Greger | 446/217 |
| 4,794,024 | A * | 12/1988 | Crowell et al. | 428/12 |
| 5,797,811 | A * | 8/1998 | Vestal | 473/514 |
| 6,053,399 | A * | 4/2000 | Wurdeman | B65D 27/28 229/116.2 |
| 7,409,787 | B2 * | 8/2008 | Glenn | 40/124.09 |

* cited by examiner

*Primary Examiner* — Syed A Islam
(74) *Attorney, Agent, or Firm* — Sheppard, Mullin, Richter & Hampton LLP

(57) ABSTRACT

A foldable greeting card and method of making the card, with a polygonal base with hinged lobes attached to the edges of the base, with the lobes foldable inward to the center of the base. The lobes overlap neighboring lobes. The card is made by affixing at least two separate units to each other, so that each hinged lobe overlaps by a neighboring lobe and is overlapped by a neighboring lobe. A message or graphic may be placed on the lobes or the base.

9 Claims, 7 Drawing Sheets

PETAL SHAPED GREETING CARD AND METHOD

TECHNICAL FIELD

The presently disclosed and claimed inventive concepts generally relate to greeting cards, and more particularly to folding greeting cards and methods for making them.

BACKGROUND

Greeting cards are available in a wide array of shapes, sizes, and themes to provide for many different occasions. Designs that are exceptionally pleasing to the eye, portray a desirable message, or are found otherwise entertaining are more likely to become popular among consumers. Cards have used various colors and materials as well as different folding patterns to become aesthetically pleasing.

SUMMARY OF THE DISCLOSURE

The inventive concepts relate to a folding greeting card. The greeting card has a regular polygonal base. Attached to the polygon edges are flaps, which we call hinged lobes. The flaps are generally fan-shaped, having diverging left and right side edges and a curving outer edge opposite the straight edge of attachment. Additionally, each flap overlaps with adjacent flaps. The flaps are attached to the outside edges of the polygonal body to allow the flaps to rotate around the attachment point. The flaps rotate from a position extending away from the polygonal body to a position pointing toward the center of the polygonal body, in a 180 degree arc. Acceptable polygons are octagons, squares, pentagons, hexagons, and heptagons.

The inventive concepts also relates to a method of making a greeting card. The construction of the card begins by making two planar bodies having a main polygonal shape with hinged tabs or hinged lobes attached to alternating edges of the polygon such that no adjacent sides of the polygon have tabs and no adjacent sides of the polygon are without tabs. The planar bodies are made by a technique such as cutting from a larger piece of paper. Once the planar bodies are cut, the two planar bodies are affixed to each other, with one planar body overlaying the other in such a way that the tabs from the upper body align with the spaces on the lower body and the tabs from the lower body align with the spaces on the upper body. When thus joined, each tab is positioned to partially overlap one adjacent tab, and to be overlapped by a tab on the opposite side. Once the bodies are in place and affixed, the tabs are scored or creased near the tab base to allow the tabs to uniformly fold toward the interior of the polygonal bodies. In the finished product, the tabs or hinged lobes are movable in a 180 degree are toward and away from the center of the planar bodies.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept (s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DEFINITIONS

Figure 1:
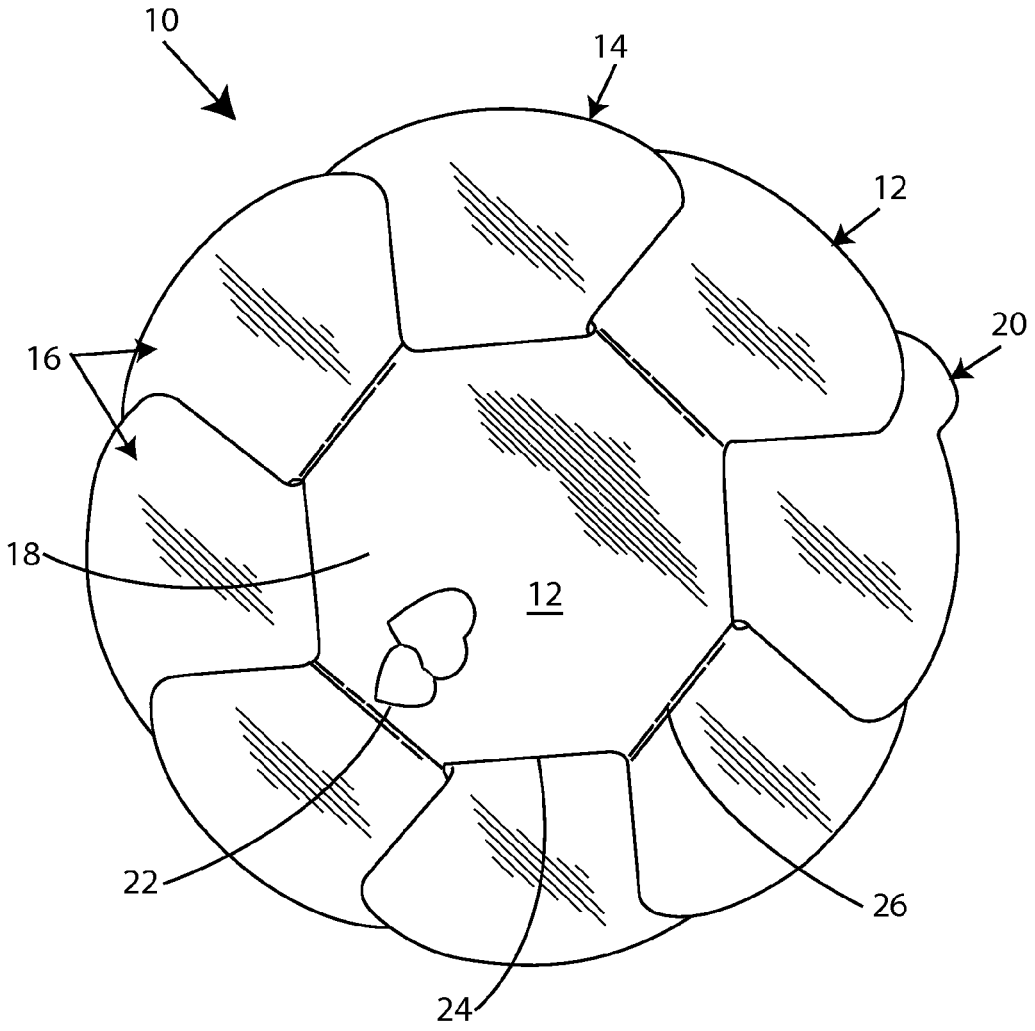
FIG. 1 is a top view of the interior of the card laying flat with the tabs unfolded.

In the following description and in the figures, like elements are identified with like reference numerals.

The use of "including" means "including, but not limited to," unless otherwise noted.

DETAILED DESCRIPTION OF THE EXEMPLARY EMBODIMENTS

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Figure 2:
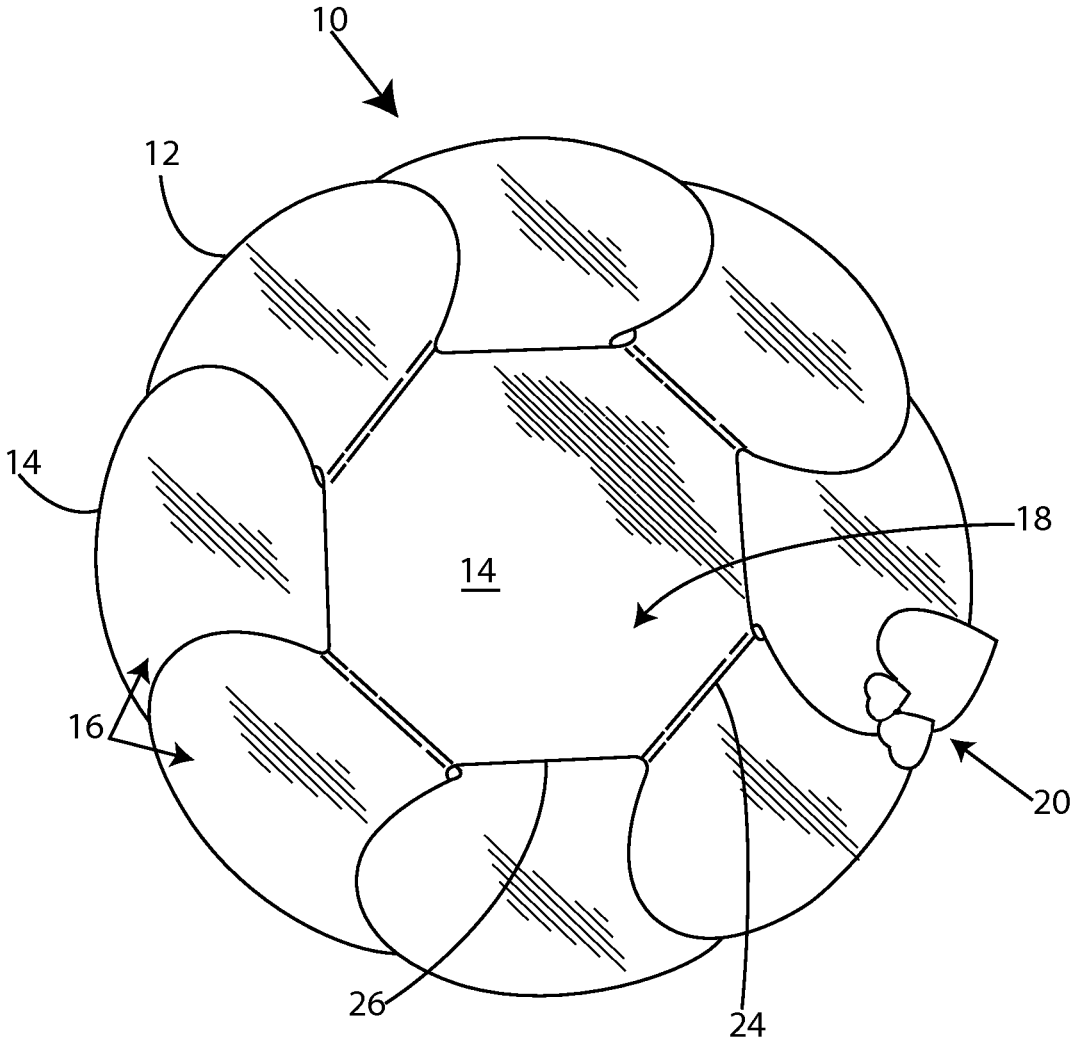
FIG. 2 is a top view of the exterior of the card laying flat with the tabs unfolded.

FIGS. 1-2 illustrate a greeting card 10 in a first position where hinged lobes 16 are completely unfolded and laid flat. The greeting card 10 has a first planar body 12 and a second planar body 14. Each planar body has polygonal base 18 with hinged lobes 16 attached to alternating sides of the polygon base 18. A preferred embodiment of the device has a polygonal base 18 with an even number of sides, with eight sides being shown. The polygonal base can also have an odd number of sides. While not required, at least one of said hinged lobes 16 may have a protuberance 20 creating additional display area for decoration, text, or other purpose. First planar body 12 is affixed to second planar body 14 so that the hinged lobes 16 of first planar body 12 align to an empty slot 24 of second planar body 14. Once first planar body 12 is affixed to second planar body 14 each hinged lobe 16 overlaps one adjacent hinged lobe 16 and is overlapped itself on its opposite side. The polygonal base 18 can be printed with an inner message 22 or left blank for the user to write a personal message. The first and second planar bodies can be affixed to each other by any common means, such as use of an adhesive, heat bonding, chemical bonding, or a physical bonding such as by use of tabs and slots.

Figure 3:
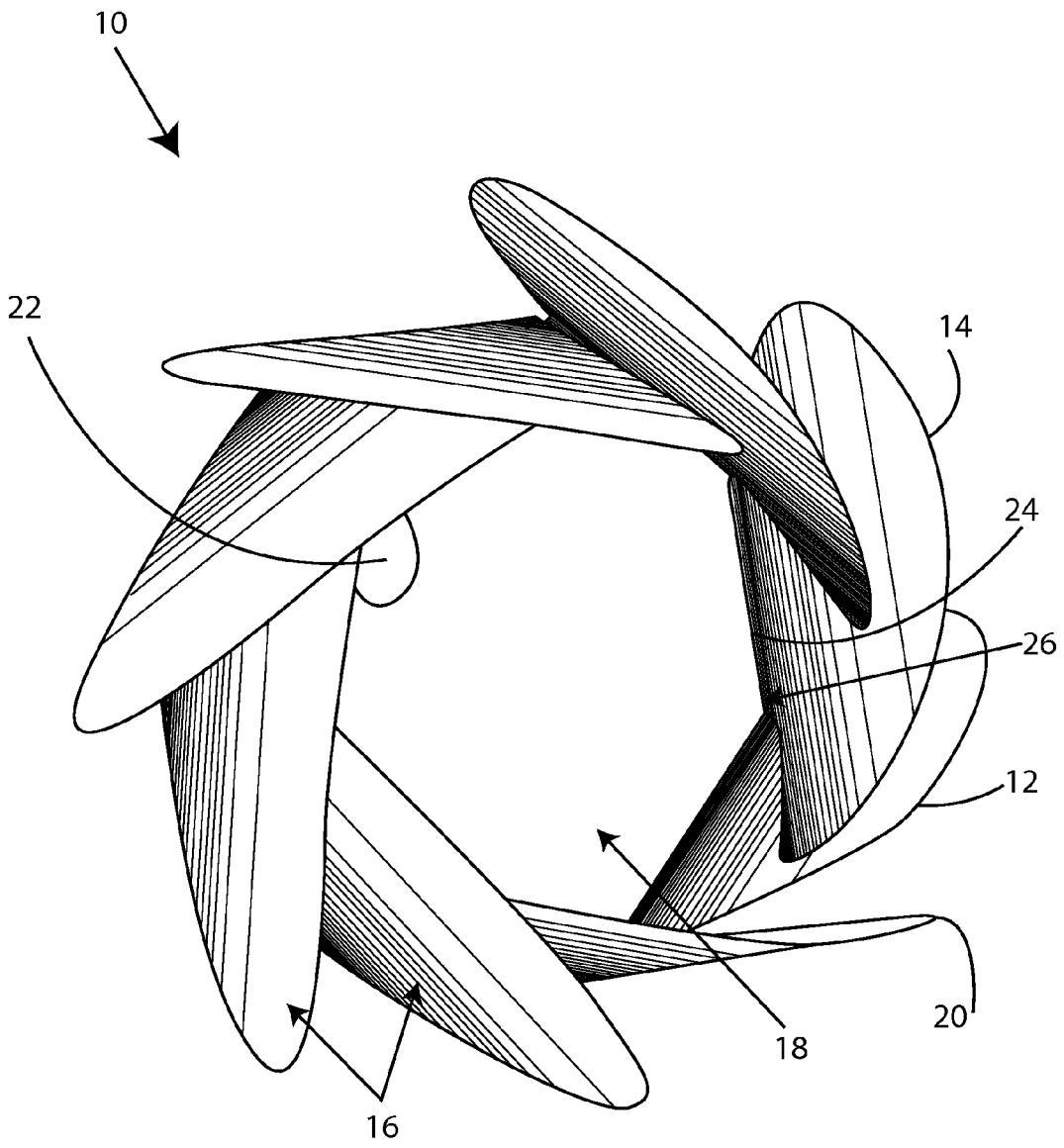
FIG. 3 is a perspective view of the card lying on its back with the tabs partially folded inward.

FIG. 2 shows the underside of a greeting card. FIG. 3 illustrates a greeting card 10 with hinged lobes 16 partially folded. The hinged lobes 16 fold toward the center of the polygonal base 18 along creases 26. The creases 26 are along the edge of polygonal base 18. During folding, each hinged lobe 16 has one side behind an adjacent hinged lobe 16 with the opposite side being in front of an adjacent hinged lobe 16.

Figure 4:
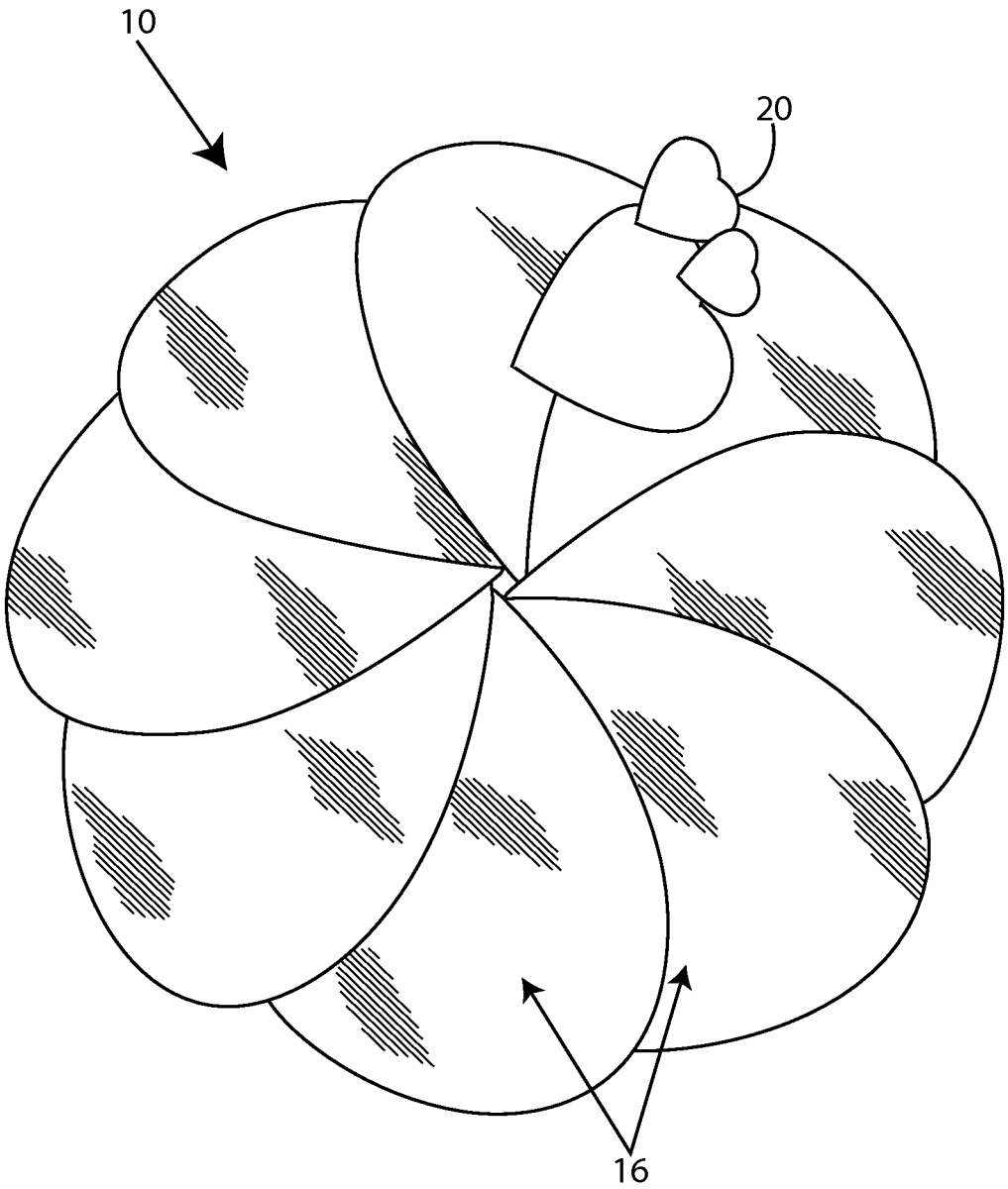
FIG. 4 is a perspective view of the front of the card with all tabs folded inward.

FIG. 4 illustrates a greeting card 10 in a second position where hinged lobes 16 are fully folded toward the center of the polygonal base 18. The hinged lobes 16 are sized to fold flat without interfering with other hinged lobes 16 attached to the polygonal base 18. The protuberance 20 has been designed to display a shape and message that is not present on the other hinged lobes 16.

Figure 5:
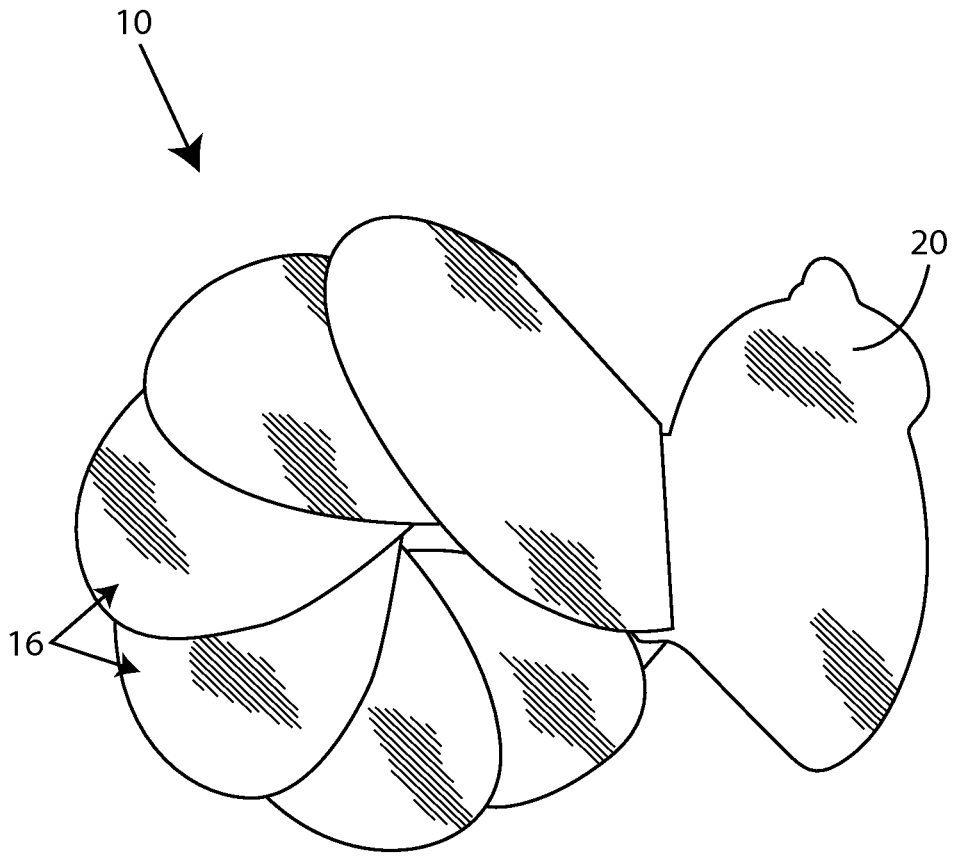
FIG. 5 is a top view of the front of the card with only the tab with the protuberance unfolded.
Figure 6:
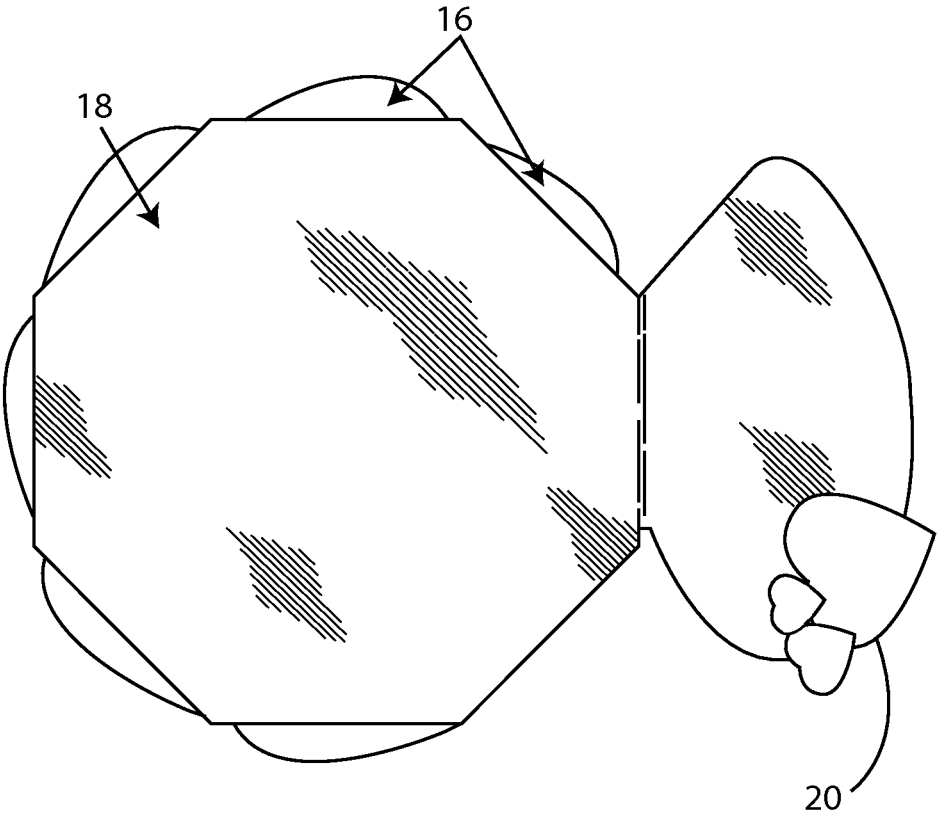
FIG. 6 is a top view of the back of the card with only the tab with the protuberance unfolded.

FIGS. 5-6 illustrate a greeting card 10 with all hinged lobes 16 fully folded toward the center of the polygonal base 18 except one hinged lobe 16, on which is the protuberance 20, being fully unfolded. The protuberance 20 extends the border of a hinged lobe to accommodate different designs and messages that would not be present otherwise. Having such a protuberance is an optional feature.

Figure 7:
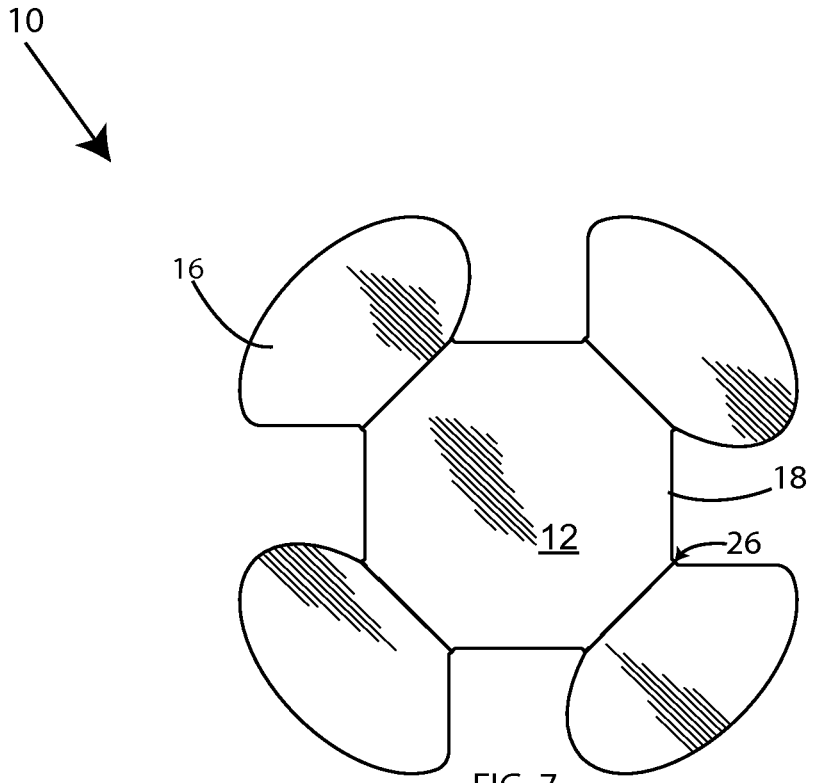
FIG. 7 is a top view of the first planar body of a version of the disclosed card.
Figure 8:
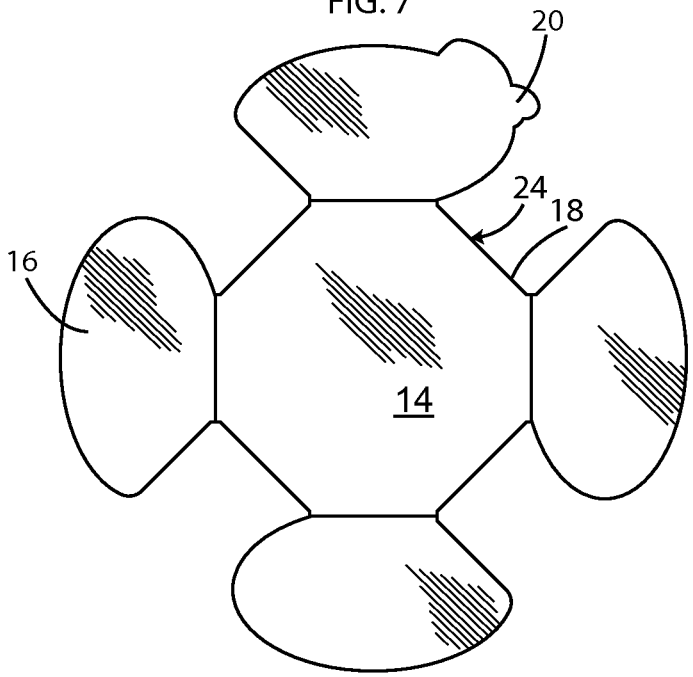
FIG. 8 is a top view of the second planar body of a version of the disclosed card.

FIGS. 7 and 8 show the first planar body 12 and the second planar body 14 of the disclosed device. These two planar bodies are attached to each other to form a finished card.

While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A method of making a greeting card comprising the steps of:

providing a first planar body comprising a first polygon and hinged lobes extending from alternating sides of said first polygon, such that remaining sides of said first polygon do not have lobes extending therefrom;

providing a second planar body comprising a second polygon and hinged lobes extending from alternating sides of said second polygon, such that remaining sides of said second polygon do not have lobes extending therefrom;

overlaying and affixing the first polygon onto the second polygon, with edges of the first and second polygons being aligned such that the hinged lobes of the first planar body alternate with the hinged lobes of the second planar body;

wherein said lobes are movable between a first position and a second position;

wherein in the first position said lobes are unfolded and extend outwardly to form a flat, open greeting card, and wherein in the second position said lobes are folded inwardly to form a flat, closed greeting card;

wherein in both the first and second positions, each one of said lobes at least partially overlap one of adjacent lobes.

2. The method of claim 1, wherein the first and second polygons comprise an even number of sides.

3. The method of claim 2, wherein the polygons are octagons of the same size.

4. A folding greeting card comprising:

a first planar body comprising a first base and a first set of hinged lobes extending from a first set of alternating edges of said first base;

a second planar body comprising a second base and a second set of hinged lobes extending from a second set of alternating edges of said second base;

wherein the first and second planar bodies are coupled to one another at the first and second bases and the first and second set of alternating edges are aligned such that each one of the first set of hinged lobes at least partially overlaps adjacent ones of the second set of hinged lobe in both an open position and a closed position;

wherein in the open position, the first and second hinged lobes extend outwardly from the first and second bases, respectively, and wherein in the closed position, the first and second hinged lobes are folded on top of the first and second bases, respectively.

5. The folding greeting card of claim 4, wherein the first and second bases are shaped and sized identically.

6. The folding greeting card of claim 5, wherein the first and second bases are polygonal.

7. The folding greeting card of claim 6, wherein the first and second polygonal bases are octagons.

8. The folding greeting card of claim 5, wherein the greeting card has a shape that is different from the first and second polygonal bases in the closed position.

9. The folding greeting card of claim 8, wherein the shape is substantially circular.

* * * * *